US008896646B2

(12) United States Patent
Inoue et al.

(10) Patent No.: US 8,896,646 B2
(45) Date of Patent: Nov. 25, 2014

(54) PRINTER AND PAPER FEEDING METHOD FOR PRINTER DEVICE

(75) Inventors: Sayuri Inoue, Tsuru (JP); Takuro Kohyama, Nishitokyo (JP)

(73) Assignees: Citizen Holdings Co., Ltd., Tokyo (JP); Citzen Systems Japan Co., Ltd., Tokyo (JP)

( * ) Notice: Subject to any disclaimer, the term of this patent is extended or adjusted under 35 U.S.C. 154(b) by 0 days.

(21) Appl. No.: 13/885,799

(22) PCT Filed: Aug. 30, 2011

(86) PCT No.: PCT/JP2011/069570

§ 371 (c)(1),
(2), (4) Date: May 16, 2013

(87) PCT Pub. No.: WO2012/066837

PCT Pub. Date: May 24, 2012

(65) Prior Publication Data

US 2013/0233913 A1 Sep. 12, 2013

(30) Foreign Application Priority Data

Nov. 17, 2010 (JP) ..... 2010-256737

(51) Int. Cl.

| | |
|---|---|
| ***B41J 2/32*** | (2006.01) |
| ***B41J 3/407*** | (2006.01) |
| ***B65H 35/06*** | (2006.01) |
| ***B41J 11/70*** | (2006.01) |

(52) U.S. Cl.

CPC ..... *B41J 3/4075* (2013.01); *B65H 35/06* (2013.01); *B41J 11/70* (2013.01)

USPC ..... 347/197

(58) Field of Classification Search

USPC ..... 347/197, 198, 171, 218

See application file for complete search history.

(56) References Cited

U.S. PATENT DOCUMENTS 5,717,836 A 2/1998 Horie
7,283,147 B2 * 10/2007 Sago et al. ..... 347/198

(Continued)

FOREIGN PATENT DOCUMENTS

CN 1136999 12/1996
CN 1702696 11/2005

(Continued)

OTHER PUBLICATIONS

International Search Report (ISR) issued Oct. 25, 2011 in International (PCT) Application No. PCT/JP2011/069570.

(Continued)

*Primary Examiner* — Kristal Feggins
(74) *Attorney, Agent, or Firm* — Wenderoth, Lind & Ponack, L.L.P.

(57) ABSTRACT

A printer includes a printing unit having a platen roller, a power unit including a stepping motor and a gear train, a cutting unit provided at a further downstream of a forward direction than the platen roller to cut a paper at a predetermined position, the forward direction in which the paper printed by the printing unit is fed by the forward rotation of the platen roller, and a control unit to control the driving of the stepping motor and the operation of the cutting unit. The control circuit controls the platen roller to rotate forward and place a certain portion of the paper at a predetermined position of the cutting unit on standby for a predetermined time, then controls the cutting unit to cut the paper, and after the cutting, controls the platen roller to rotate forward by a minimal number of steps necessary to remove backlash.

14 Claims, 9 Drawing Sheets

(56) References Cited

U.S. PATENT DOCUMENTS

| | | | | |
|---|---|---|---|---|
| 7,819,597 | B2 * | 10/2010 | Kohira | 347/197 |
| 8,477,168 | B2 * | 7/2013 | Takami et al. | 347/218 |
| 2005/0271446 | A1 | 12/2005 | Minowa | |
| 2006/0062623 | A1 | 3/2006 | Kohira | |

FOREIGN PATENT DOCUMENTS

| | | |
|---|---|---|
| JP | 61-150962 | 7/1986 |
| JP | 64-87377 | 3/1989 |
| JP | 5-246092 | 9/1993 |
| JP | 6-30598 | 2/1994 |
| JP | 7-52478 | 2/1995 |
| JP | 8-267864 | 10/1996 |
| JP | 2003-231313 | 8/2003 |
| JP | 2010-149416 | 7/2010 |

OTHER PUBLICATIONS

Chinese Office Action (OA) issued Sep. 2, 2014 in corresponding Chinese Patent Application No. 201180055330.5.

* cited by examiner

PRINTER AND PAPER FEEDING METHOD FOR PRINTER DEVICE

TECHNICAL FIELD

The present invention relates to a printer and a paper-feeding method of the printer. In particular, it relates to the removal of backlash of a gear train that drives a platen roller.

BACKGROUND ART

There is a printer for issuing printed papers such as tickets for entertainment or receipts as acknowledgement of a money transfer. Such a printer includes a printing unit having a platen roller rotatably supported around its shaft, a power unit including a stepping motor and a gear train which drives the stepping motor to transfer a force generated by the stepping motor to the platen roller and rotate the platen roller around the shaft, a cutting unit provided at a further downstream of a forward direction than the platen roller to cut a paper at a certain position of the paper and a control unit to control the driving of the stepping motor and the operation of the cutting unit. The forward direction is a direction in which the paper printed by the printing unit is fed by the forward rotation of the platen roller.

Such a printer performs a desired printing on papers with the printing unit while feeding the paper in the forward direction by the forward rotation of the platen roller. After the printing of the printing unit, the control unit rotates the platen roller forward by driving the stepping motor by a first number of steps to feed the paper to the downstream of the forward direction and place a certain portion (unprinted portion at more upstream than the printed portion) of the paper at a predetermined position of the cutting unit.

Here, the platen roller is rotated by transferring the force generated by the stepping motor driven by the control unit to the platen roller via the gear train.

Furthermore, due to the backlash of the gear train as the power unit, the platen roller may rotate idly (rattle) in the paper feeding direction by the amount of backlash.

By the idle rotation of the platen roller, a printing position of the printing unit may be shifted and illegible lettering may occur due to overlapping printing caused by insufficient paper feeding.

In view of this, a printer which can remove the backlash by reversely rotating the stepping motor by the amount equal to or exceeding the backlash has been proposed (Patent Documents 1, 2).

In addition, a driving method of the stepping motor of the printer has been proposed, which removes the backlash by rotating the stepping motor by a predetermined number of steps in the forward direction corresponding to the paper feeding direction after power-on or paper cutting (Patent Documents 3, 4).

CITATION LIST

Patent Documents

[Patent Document 1] JP-A-Hei 8-267864
[Patent Document 2] JP-A-Hei 6-30598
[Patent Document 3] JP-A-Sho 64-87377
[Patent Document 4] JP-A-Hei 5-246092

DISCLOSURE OF THE INVENTION

Problem to be Solved by the Invention

Meanwhile, a paper is printed by the printing unit while the platen roller is feeding the paper forward. After completion of the printing, the printed paper needs to be cut from a non-printed paper. Therefore, the control unit drives the stepping motor by a predetermined number of steps to rotate the platen roller forward and feed the paper forward by a certain length.

Then, immediately after the stepping motor has stopped driving, the platen roller is oscillated in the paper feeding direction or rotational direction due to the backlash of the gear train or the allowance of the supported portion of the platen roller.

There is a problem that the paper cutting position of the cutting unit varies in the paper-feeding direction since the cutting unit cuts the paper immediately after the stopping of the driving of the stepping motor.

With such a variation in the cutting position, not only varies the distance (length of not-printed margin) between the tip of the paper formed by the cutting and a next printing start position but also varies the backlash by a variation in the positions of the gear train and platen roller. This makes it difficult to improve printing quality.

In view of the above, an object of the present invention is to provide a printer and a paper-feeding method of the printer that can reduce variations in the cutting position in the paper-feeding direction as well as variations in the backlash.

Means to Solve the Problem

The printer and paper-feeding method of the printer according to the present invention are to place the platen roller on standby for a predetermined time until the oscillation thereof is settled, after a printed paper is carried to the cutting unit and before it is cut thereby, and to rotate the platen roller forward after completion of the paper cutting for the purpose of removing the backlash.

Specifically, the printer according to the present invention comprises a printing unit having a platen roller rotatably supported around a shaft, a power unit including a stepping motor, and a gear train to drive the stepping motor to transfer a force generated by the stepping motor to the platen roller and rotate the platen roller around the shaft, a cutting unit provided at a further downstream of a forward direction than the platen roller to cut a paper at a predetermined position, the forward direction in which the paper printed by the printing unit is fed by a forward rotation of the platen roller, and a control unit to control a driving of the stepping motor and an operation of the cutting unit, in which the control unit is configured to drive the stepping motor by a first number of steps to rotate the platen roller forward and place a certain portion of the paper at a predetermined position of the cutting unit on standby for a predetermined time, and then control the cutting unit to cut the paper, and after the cutting, drive the stepping motor by a second number of steps to rotate the platen roller forward, the second number of steps being a minimal number of steps necessary to remove backlash of the gear train.

A paper-feeding method of a printer according to the present invention which comprises a printing unit having a platen roller rotatably supported around a shaft, a power unit including a stepping motor and a gear train to drive the stepping motor to transfer a force generated thereby to the platen roller and rotate the platen roller around the shaft, a cutting unit provided at a further downstream of a forward direction than the platen roller to cut a paper at a predetermined position, the forward direction in which the paper printed by the printing unit is fed by a forward rotation of the platen roller, and a control unit to control a driving of the stepping motor and an operation of the cutting unit, the method comprising the steps of, by the control unit, driving the stepping motor by a first number of steps to rotate the platen roller forward and placing a certain portion of the paper at a predetermined position of the cutting unit on standby for a predetermined time before the paper cutting by the cutting unit, and after the paper cutting by the cutting unit, driving the stepping motor by a second number of steps to rotate the platen roller forward, the second number of steps being a minimal number of steps necessary to remove backlash of the gear train.

Effect of the Invention

The printer and paper-feeding method of the printer according to the present invention can reduce variations in the cutting positions in the paper-feeding direction as well as variations in the backlash.

DESCRIPTION OF THE EMBODIMENT

Specific embodiments with regard to a printer and a paper-feeding method of the printer thereof according to the present invention are described with reference to the drawings hereinbelow.

Figure 1:
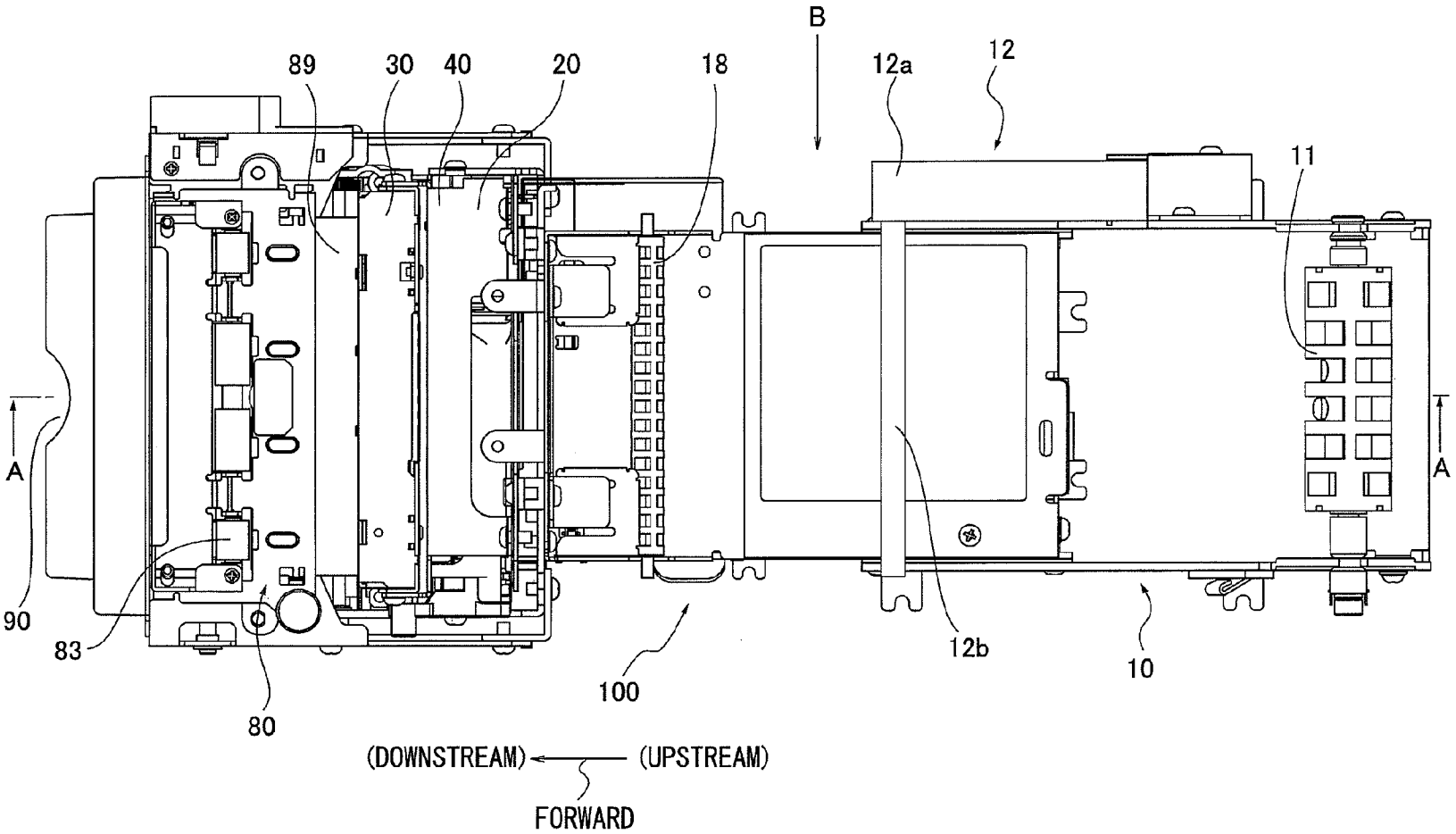
FIG. 1 is a plan view of a printer according to one embodiment of the present invention.
Figure 2:
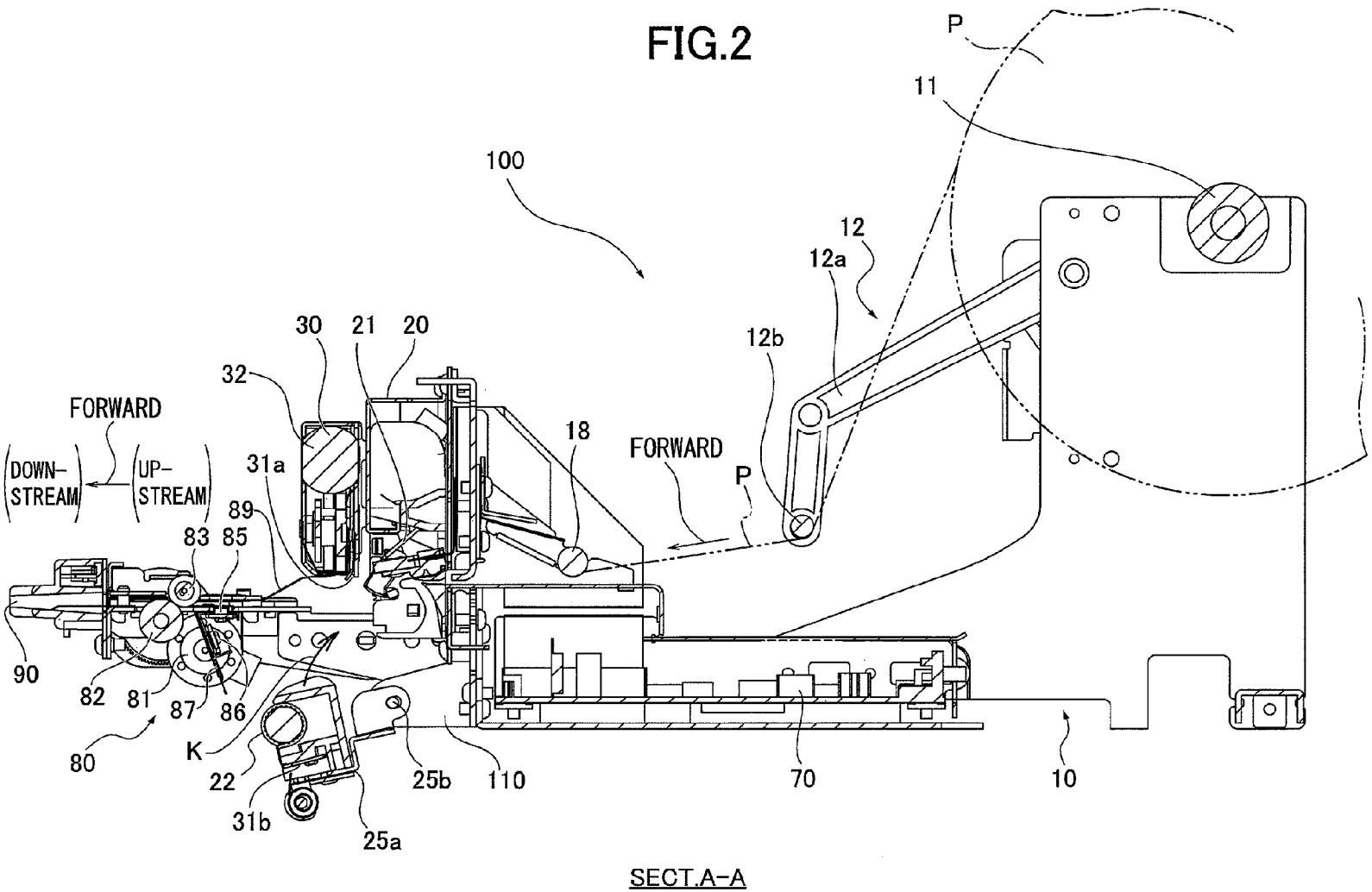
FIG. 2 is a cross section view along the A-A line in FIG. 1.
Figure 3:
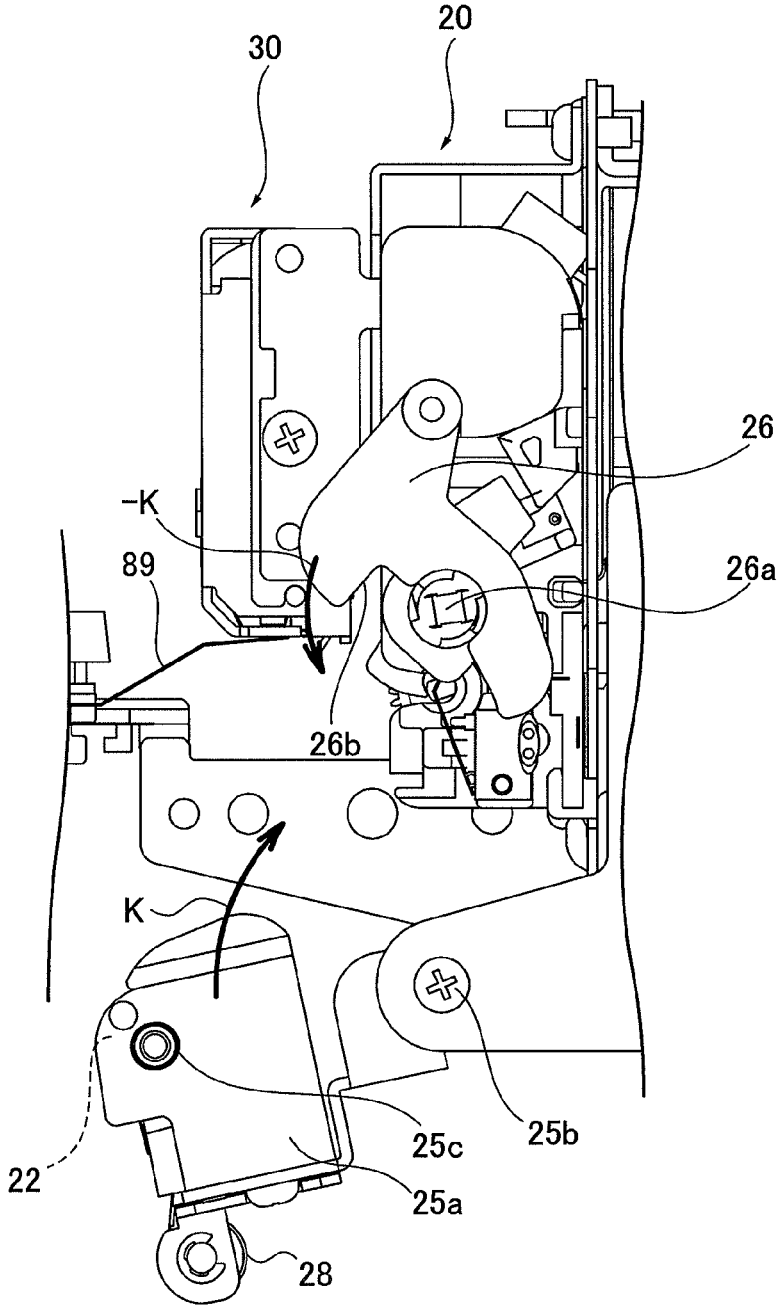
FIG. 3 shows a printer unit in a non-printable state in which the stopper of a metal plate is come off from a hook of a locking member provided in a unit body.
Figure 4:
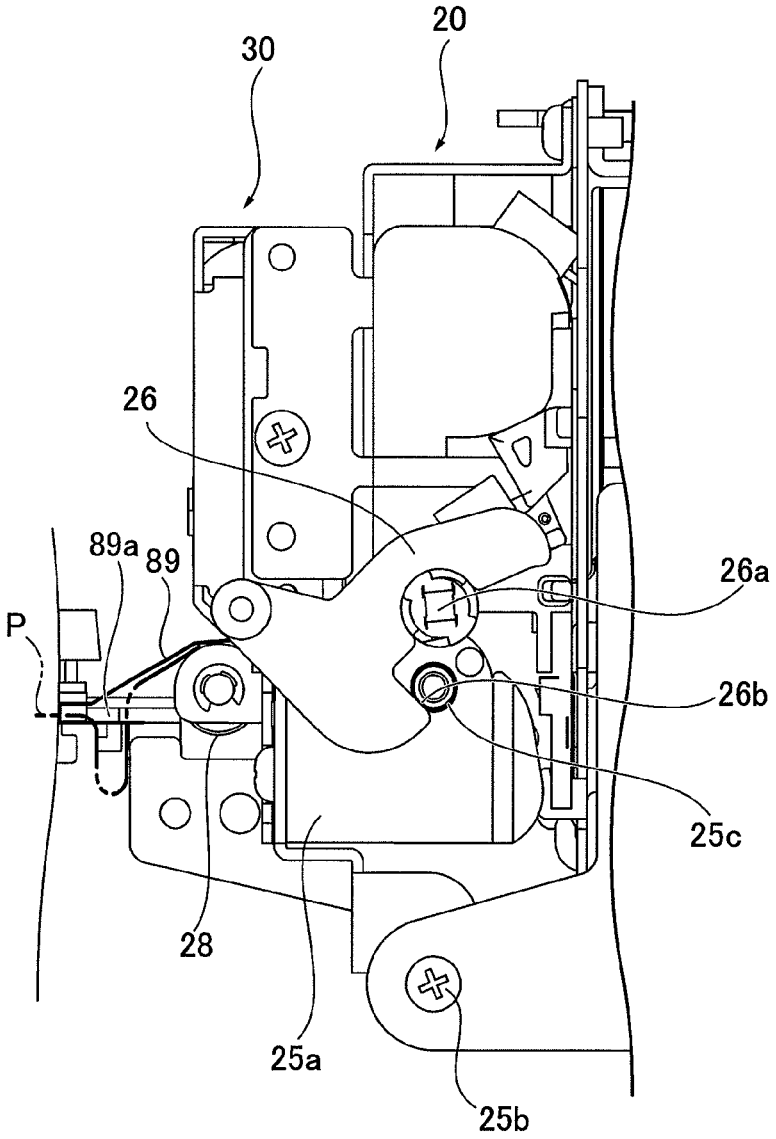
FIG. 4 shows the printer unit in a printable state in which the stopper of the metal plate is engaged with the hook of the locking member provided in the unit body.
Figure 5:
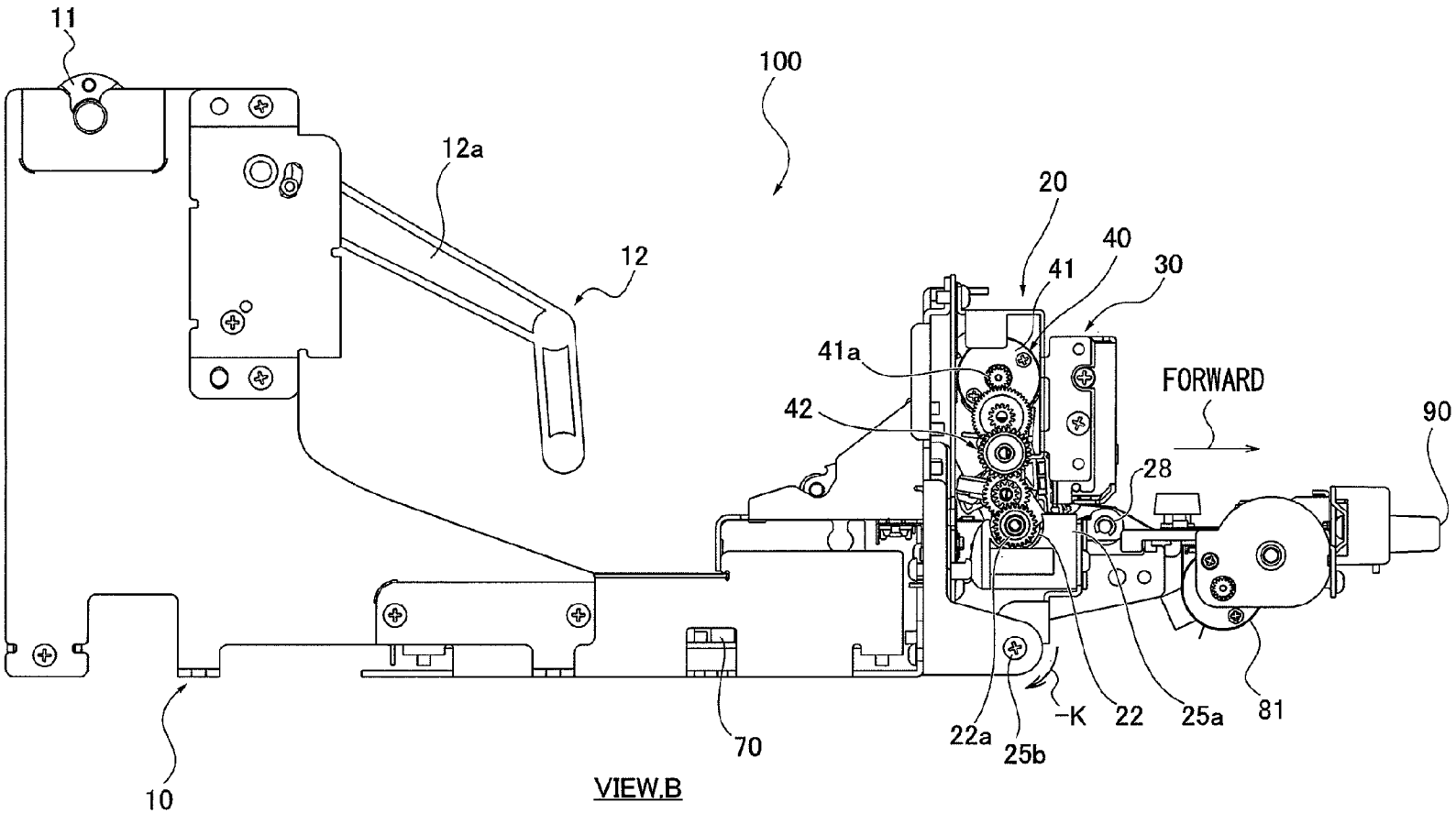
FIG. 5 is a side view seen from the arrow B in FIG. 1.

FIG. 1 and FIG. 2 are views illustrating a printer 100 in an embodiment (Embodiment 1) of the present invention. FIG. 1 is a plan view of a printer 100. FIG. 2 is a cross section view taken along the A-A line in FIG. 1, FIG. 3 shows a non-printable state of a platen roller 22, FIG. 4 shows a printable state of the platen roller 22, and FIG. 5 is a side view seen from the arrow B in FIG. 1.

The printer 100 prints specified information (including information other than letters) on a long rolled-up paper P (heat-sensitive paper.) The paper P after printing is cut at a predetermined length and is configured to be discharged outwards from the printer 100 through a discharge port 90 (part of a ticket-issuing machine or the like).

Paper P, as indicated by a dotted chain line in FIG. 2, is rolled up before printing and supported by a paper holder 10 to be rotatable around its axis.

Next, the paper P pulled out from an edge of its roll-shaped outermost layer is fed along a feed path towards a discharge port 90. This direction of the paper P towards the discharge port 90 is termed as a forward direction (illustrated by arrows in FIG. 1 and FIG. 2).

On this feed path of the printer 100, at a more downstream of the forward direction than the paper holder 10, a control circuit 70 (control unit), a printing unit 20, a power unit 40, a cutting unit 30 and a paper feed unit 80 are disposed.

The paper holder 10 comprises a paper holder shaft 11 set across both edges of a width direction of the printer 100 on side plates thereof (hereafter termed as both side edges). A long rolled paper P is supported by the paper holder shaft 11 to be rotatable.

The paper holder 10 comprises a damper 12 that alleviates impact by inertial force of the paper P in a roll shape.

The damper 12 comprises a damper arm 12*a* extending along a side plate on one side, a damper shaft 12*b* extending along the width of the paper P to contact the paper P, and a damper spring (not-shown) that biases the damper shaft 12*b* to come into contact with the surface of the paper P.

In addition, a tension roller 18 is disposed between the paper holder 10 and the printing unit 20 to prevent an unrolled paper P from the outermost layer of the rolled paper P from loosening.

The printing unit 20 comprises a thermal print head 21 controlled by the control circuit 70 described later and a platen roller 22 (refer to FIG. 3) disposed on a reverse side to the thermal print head 21 with the paper P in between to control the feeding of the paper P relative to the thermal print head 21.

The platen roller 22 is installed on a predetermined metal plate member 25*a*. The metal plate member 25*a* in FIG. 2 is supported around a shaft 25*b* to be rotatable to a body 110 of the printer 100. As illustrated in FIG. 3, when a stopper 25*c* of the metal plate member 25*a* is unhooked from a hook 26*b* of a locking member 26 disposed on the body of the printing unit 20, the platen roller 22 is detached from the thermal print head 21.

On the other hand, if the metal plate member 25*a* is rotated around the shaft 25*b* in a direction of arrow K (clockwise) from FIG. 3, the locking member 26 is rotated around a shaft 26*a* in a direction of arrow −K (counterclockwise) to have the stopper 25*c* of the metal plate member 25*a* engaged with the hook 26*b* of the locking member 26 (a state illustrated in FIG. 4), the platen roller 22 is printable, facing the thermal print head 21 with the paper P in between.

Released from the engagement in FIG. 4, the metal plate member 25*a* on which the platen roller 22 is disposed rotates around the shaft 25*b* in a direction of arrow −K so that the platen roller 22 becomes detached from paper P, making printing unfeasible.

Also, to return the platen roller 22 from the released state to the locked state in FIG. 3, the metal plate member 25*a* with the platen roller 22 is rotated around the shaft 25*b* in a direction of arrow K so that the platen roller 22 is strongly pressed onto a lower surface of the paper P and the hook 26*b* of the locking member 26 is engaged with the stopper 25*c* of the metal plate member 25*a* (as illustrated in FIG. 4).

An idle roller 28 that rotates idly is also disposed on the metal plate member 25*a* to serve as a guide of the paper P on the feed path in addition to the platen roller 22.

In addition, as illustrated in FIG. 5, a platen roller gear 22*a* that rotates around the same shaft together with the platen roller 22 is disposed on the platen roller 22.

The power unit 40 includes a stepping motor 41 controlled to drive by a step number by the control circuit 70, and a gear train 42 that transfers the force generated by the driving of the stepping motor 41 to the platen roller 22 for rotating the platen roller 22 around its shaft.

That is, the stepping motor 41 includes a motor gear 41*a* on a rotating shaft. By the engagement of the motor gear 41*a* with the gear train 42, the force generated by the driving of the stepping motor 41 is transferred to the gear train 42. In addition, when the stopper 25*c* of the metal plate member 25*a* supporting the platen roller 22 is engaged with the hook 26*b* of the locking member 26 (refer to FIG. 4), the gear train 42 is engaged with the platen roller gear 22*a* so that the force transferred to the gear train 42 is transferred to the platen roller 22.

Meanwhile, when the stopper 25*c* of the metal plate member 25*a* supporting the platen roller 22 is not locked with the hook 26*b* of the locking member 26 (refer to FIG. 3), the gear train 42 is not engaged with the platen roller gear 22*a* so that the force transferred to the gear train 42 is not transferred to the platen roller 22. Thereby, the platen roller 22 does not rotate.

A driving direction (rotating direction), a driving speed (rotating speed) and a driving amount (number of steps) of the stepping motor 41 are controlled by the control circuit 70. A rotating direction in which the paper P is fed towards the downstream side of the forward direction shown in the drawings is hereunder termed as a forward rotational direction. A rotating direction in which the paper P is fed towards the upstream of the forward direction (back feed) shown in the drawings is hereunder termed as a reverse rotational direction.

The rotating directions of the platen roller 22 are similarly defined with the above-mentioned feeding direction of the paper P set as a standard. That is, a rotating direction in which the paper P is fed towards the downstream of the forward direction is termed as a forward rotational direction, and a rotating direction in which the paper P is fed towards the upstream of the forward direction shown in the drawings is termed as a reverse rotational direction.

Since the printer 100 in the present embodiment uses a general commercial power source that drives the stepping motor 41 as a power source, illustration of such a power source is omitted. However, the printer according to the present invention can also use primary or secondary batteries or the like as the power source.

The cutting unit 30 is disposed at a more downstream of the forward direction of the paper P printed by the printing unit 20 than the platen roller 22. The cutting unit 30 includes a movable cutter blade 31*a* (cutting unit) disposed above the paper P shown in the drawings to cut the paper P in a predetermined position at a right angle to the feeding direction, a fixed cutter blade 31*b* (cutting unit) disposed on the metal plate member 25*a* below the paper P shown in the drawings, and a cutter motor 32 which drives the movable cutter blade 31*a* of the two cutter blades 31*a*, 31*b* vertically.

Driving of the cutter motor 32 is controlled by the control circuit 70. By moving the movable cutter blade 31*a* downwards, the paper P is cut by the fixed cutter blade 31*b* and the movable cutter blade 31*a* at a right angle to the feeding direction.

Then, after cutting, the control circuit 70 controls the cutter motor 32 to pull the movable cutter blade 31*a* upward and maintain such a pulled-up state till a next cutting operation.

The paper feed unit 80 is disposed between the cutting unit 30 and the discharge port 90 (a range more downstream side than the cutting unit 30 but more upstream side than the discharge port in the forward direction of the paper P). The paper feed unit 80 includes feed rollers (presenter roller) 82, 83 that feed the paper P in the forward direction or its reverse direction (reverse feeding direction), and a feed motor 81 controlled by the control circuit 70 that drives the feed roller 82.

The feed motor 81 is a stepping motor, and a driving direction (rotating direction), driving speed (rotating speed) and driving amount (step number) of the feed motor 81 are controlled by the control circuit 70. A rotating direction of the feed roller 82 in which the paper P is fed towards the downstream of the forward direction is termed a forward rotational direction (a rotating direction corresponding to a direction in which the paper P is fed towards the discharge port 90), and a rotating direction in which the paper P is fed in a reverse feeding direction is termed as a reverse rotational direction.

The feed roller 82 of the feed rollers 82, 83 directly driven by the feed motor 81 is disposed to contact the bottom surface of the paper P, and the feed roller 83 as an idle roller not directly driven by the feed motor 81 is disposed to contact the upper surface of the paper P.

Therefore, the paper P is sandwiched between the feed rollers 82, 83 to be fed in the forward direction by the rotation of the feed roller 82 towards the forward rotational direction, and also fed in the reverse feeding direction by the rotation of the feed roller 82 in the reverse rotational direction.

The control circuit 70 controls a thermal print head 21 of the printing unit 20, indirectly controls the platen roller 22 by controlling the stepping motor 41, and controls the cutter motor 32 of the cutting unit 30, and the feed motor 81 of the paper feed unit 80.

Specifically, during the printing operation by the printing unit 20, the control unit 70 controls the thermal print head 21 and the stepping motor 41 for thermal printing while feeding paper P in the forward direction.

During the printing operation, a tip of the paper P at the downstream of the forward direction passes through the cutting unit 30 towards a further downstream along a paper guide plate 89 disposed at a further downstream of the forward direction than the cutting unit 30 until the tip end is placed between the feed rollers 82, 83 of the paper feed unit 80.

Hereby, the feed rollers 82, 83 are rotated by the forward rotations of the feed motor 81 controlled by the control circuit 70. A detection sensor 85 (as illustrated in FIG. 2) of a photoreflector or the like is disposed at a more upstream of the forward direction than the feed rollers 82, 83 to detect the presence or absence of the paper P. When the tip of the paper P at the downstream of the forward direction is detected by the detection sensor 85 and a number of prescribed steps (corresponding to a distance between the detection sensor 85 and the feed rollers 82, 83 along the feed path) has passed, the control circuit 70 determines that the tip of the paper P has reached the feed rollers 82, 83. Thereby, the control circuit 70 controls the feed motor 81 to stop driving to stop the rotations of the feed rollers 82, 83.

The tip of the paper P is stopped by the stopping of the feed rollers 82, 83. While printing operation further continues, the platen roller 22 continues to rotate forward so that a length of the paper P carried between the printing unit 20 and the feed rollers 82, 83 can be longer than a length of the feed path between the printing unit 20 and the feed rollers 82, 83. In this case, as illustrated in FIG. 4, a portion of the paper P (as indicated by the dotted chain lines illustrated in FIG. 4) exceeding the length of the feed path is accommodated in a gap 89*a* formed down below the paper guide plate 89 and deflected.

After completion of the controls over the printing operation of the printing unit 20, the control circuit 70 further drives the stepping motor 41 by a first number of steps n1 to rotate the platen roller 22 forward so that a predetermined portion (a non-printed portion at a further upstream by a predetermined length in the forward direction than the printed portion by the printing unit 20) of the paper P is placed at a position (predetermined position) to be cut by the cutter blades 31*a*, 31*b* of the cutting unit 30.

The control circuit 70 places the cutting unit 30 in a standby state for, for example, 100 [msec] (a predetermined time), and thereafter controls the driving of the cutter motor 32 of the cutting unit 30 to have the cutter blades 31*a*, 31*b* cut the paper P.

That is to say, the cutting is not performed immediately after the paper P printed by the printing unit 20 is sent to the cutting unit 30. For example, it controls the cutter motor to wait for 100 [msec] before the cutting.

The first number of steps n1 for driving the stepping motor 41 by the control circuit 70 is a prescribed value set. It can be set appropriately to a specific value according to a distance between the printing unit 20 and the cutting unit 30 or the like.

Within the paper P cut by the cutting unit 30 under the control of the control circuit 70 over the cutter motor 32, the paper P at the downstream of the forward direction is cut to a predetermined length. The paper P cut in the predetermined length is fed until the edge portion of the paper P at the upstream of the forward direction is placed between the feed rollers 82, 83 through the feed roller 82 rotating in the forward direction because of the feed motor 81 being driven according to controls by the control circuit 70. Thereafter, the feed motor 81 is controlled to reversely rotate so that the feed roller 82 is reversely rotated, whereby the feed motor 81 is stopped when the edge portion of the paper P at the upstream side of the forward direction is detected by the detection sensor 86 disposed in a dividing path for retrieval of and storing the paper P therein.

Therefore, a portion of the paper P at the downstream of the forward direction protrudes from the roller discharge port 90 on standby for a predetermined time.

The driving of the feed motor 81 is also controlled by the control circuit 70 by providing to the feed motor 81 a number of steps necessary to place an edge portion of the paper P at the upstream of the forward direction between the feed rollers 82, 83.

The control circuit 70 controls the feed motor 81 to switch the driving speed of two stages. That is, the control circuit 70 controls the feed motor 81 to drive at a high-speed angular velocity corresponding, for example, to 350 [mm/sec] in the forward direction of the paper P, and controls the feed motor 81 to switch the velocity to an intermediate angular velocity, corresponding, for example, to 300 [mm/sec] in the forward direction of the paper P slower than 350 [mm/sec], immediately before the paper P is no longer detected by the detection sensor 85 (just before an edge portion of the paper P at the upstream of the forward direction reaches the detection sensor 85).

In addition, a timing immediately before the paper P is no longer detected by the detection sensor 85 is described.

The feed motor 81 is a pulse-driven stepping motor. The control circuit 70 performs not feedback control based on the detection results by the detection sensor 85 but feed-forward control to the feed motor 81.

That is, the control circuit 70 stores a feeding amount (numbers of steps provided to the stepping motor 41) when the paper P is fed by the platen roller 22 in the printing unit 20. Based on the stored number of steps, it is possible to obtain in advance the timing immediately before an edge portion of the paper P at the upstream of the forward direction reaches the detection sensor 85 (when a remaining number of steps corresponding to the driving amount of the feed motor 81 reaches a predetermined number and until the edge portion of the paper P at the upstream of the forward direction reaches the detection sensor 85).

Thus, by providing the number of obtained steps to the feed motor 81, the paper P is fed to a position immediately before detected by the detection sensor 85. At this timing the control circuit 70 controls the feed motor 81 to change the speed to an intermediate speed of 300 [mm/sec].

In addition, after the control circuit 70 switches the driving speed of the feed motor 81 from a high velocity to an intermediate velocity, the paper P is fed towards the downstream of the forward direction by the prescribed number of steps (corresponding to a distance that the edge portion of the paper P at the upstream of the forward direction reaches the feed rollers 82, 83 after the feed speed is switched over to the intermediate velocity). Thereafter it controls the feed motor 81 to reversely rotate and to stop the feed motor 81 at a timing at which a back end part (the edge portion at the upstream of the forward direction) of the paper P is detected by the detection sensor 86, whereby a portion (close to the back end part) of the paper P is maintained to be sandwiched between the feed rollers 82, 83.

As a result, a portion of the paper P of the downstream side of the forward direction protrudes outwards from the discharge port 90 on standby to be received.

If the portion of the paper P protruding from the discharge port 90 is not received and remains on standby even after the lapse of the predetermined time, the control circuit 70 controls the feed motor 81 to reversely rotate so that the feed roller 82 is reversely rotated. Thereby, the paper P sandwiched and held between the feed rollers 82, 83 is pulled back inwardly from the discharge port 90, then fed along a retrieval guide plate 87 disposed on a more upstream of the forward direction than the feed rollers 82, 83, and then retrieved in a retrieval box or the like disposed below the retrieval guide plate 87.

Similarly to the detection sensor 85, a detection sensor 86 is disposed on the retrieval guide plate 87 to detect the presence or absence of the paper P. The presence of the paper P is detected by the detection sensor 86 while the paper P is fed along the retrieval guide plate 87. If the paper P is retrieved in the retrieval box and detached from the retrieval guide plate 87, the detection sensor 86 does not detect the presence of the paper P anymore. By a change in the detection of the detection sensor 86 from a presence to a non-presence of the paper P, the control circuit 70 stops the reverse rotation of the feed motor 81.

In addition, the control circuit 70 determines that the paper P is waiting to be received, for example, while the detection sensor 86 is detecting the presence of the paper P, and determines that the paper P has been received when the result of the detection by the detection sensor 86 is changed from present to not-present (the non-presence of the paper P detected) during non-driving of the feed motor 81.

In addition, the feed roller 82 and the feed roller 83 are provided with a sensor (for example, an encoder) that detects the rotation thereof. The sensor is configured to detect the rotation of the feed rollers 82, 83 holding the paper P when the paper P is pulled out. Then the control circuit 70 can determine the receipt or non-receipt of the paper P based on the detection results of the sensor.

On the other hand, within the paper P cut by the cutting unit 30, the paper P at the upstream of the forward direction is sandwiched between the platen roller 22 and the thermal print head 21. After the paper P is cut, the control circuit 70 controls the stepping motor 41 to drive by a second number of steps n2 and rotate the platen roller 22 forward.

This second number of steps n2 is a preliminarily set prescribed value calculated by experiment or the like. However, the specific value of the prescribed value is properly set as a minimum number of steps necessary to remove backlash generated to the gear train 42 when the paper P is completely cut. A step number, for example, corresponding to a portion of 8 letter printing dots of the thermal print head that feeds the paper P towards the downstream of the forward direction or the like can be adopted therein.

The specific values of this second number of steps n2 can be adopted arbitrarily, for example, in accordance with a thickness of the tested paper P.

That is, as the thickness of the paper P becomes thicker, the second number of steps n2 can be made larger, and as the thickness of the paper P becomes thinner, the second number of steps n2 can be made smaller.

In addition, a thickness input portion that receives input of a thickness of the paper P can be disposed. The thickness inputted to the thickness input portion can be inputted to the control circuit 70 as the thickness of the paper P. A thickness of the paper P and the second number of steps n2 pre-stored in the control circuit 70 can be corresponded together to form a reference table thereby referenced by the control circuit. The second number of steps n2 corresponded to the thickness inputted therein can be inputted to the stepping motor 41.

Figure 6:
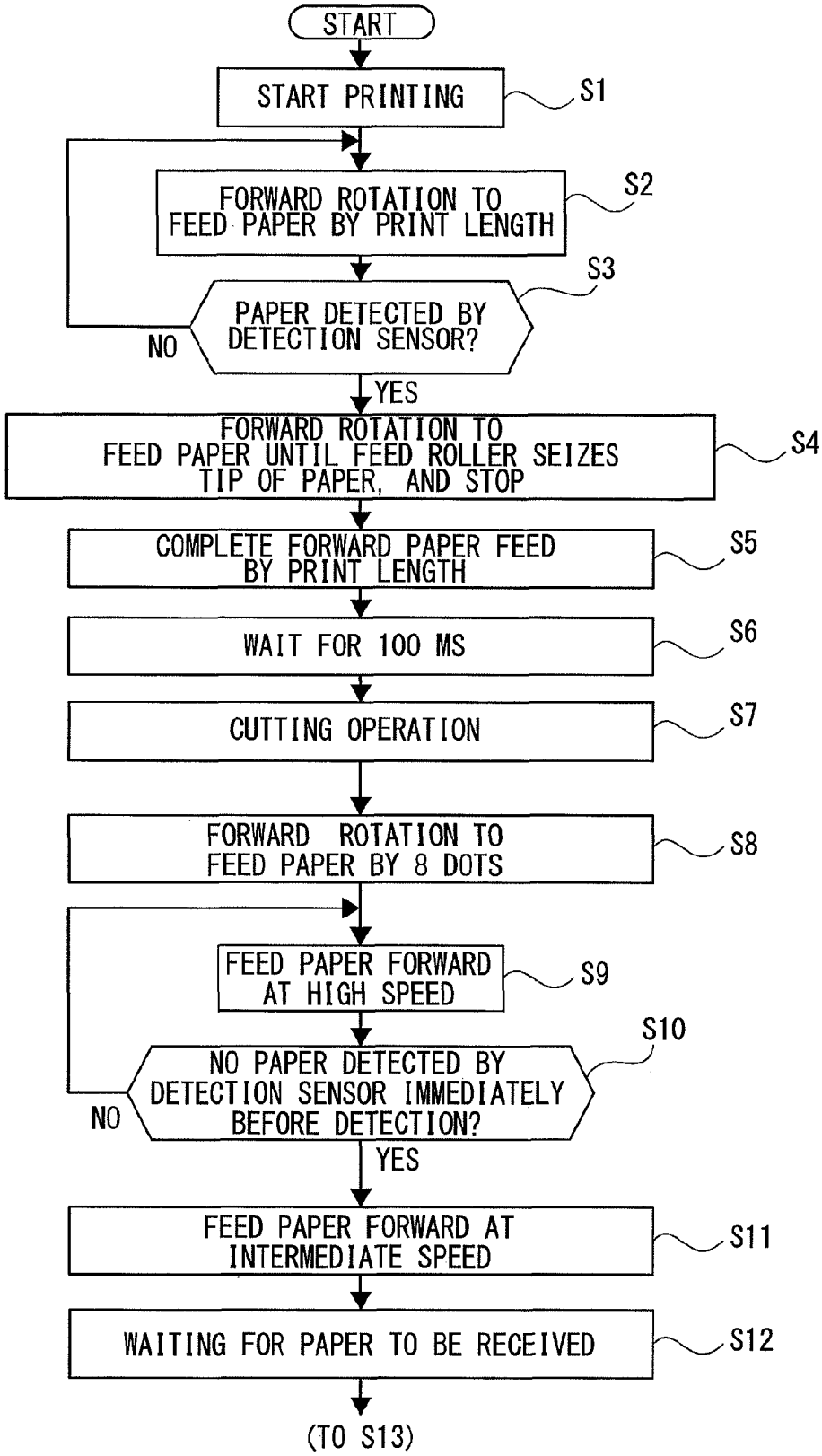
FIG. 6 is a flowchart (part 1) for the control by a control circuit of the printer according to a first embodiment.
Figure 7:
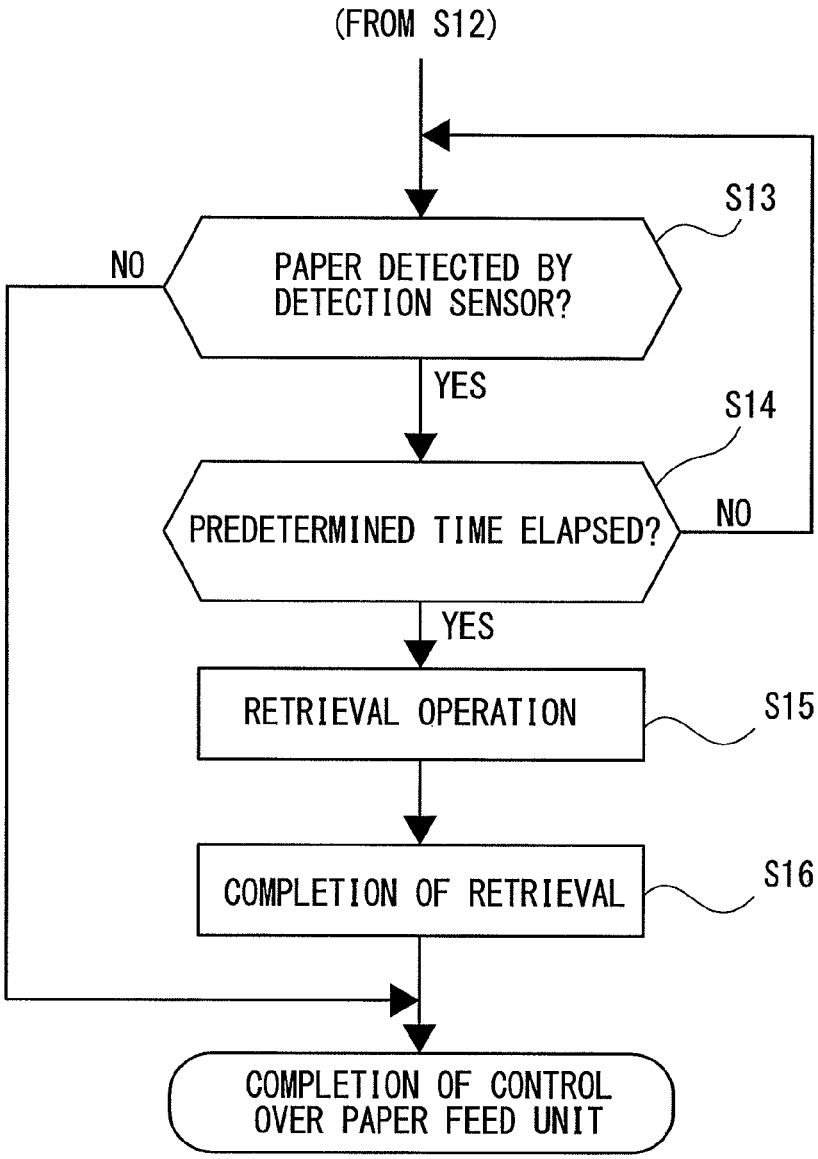
FIG. 7 is a flowchart (part 2) for the control by the control circuit of the printer according to the first embodiment.

According to the printer 100 of the present embodiment constituted as above, as illustrated in the flow chart of FIG. 6, printing operation (printing by the thermal print head 21 (S1) and print feeding by the platen roller 22 (S2)) is performed to the paper P according to control by the control circuit 70, and the tip of the paper P at the downstream of the forward direction is stopped by the feed rollers 82, 83 (S3, S4).

The control circuit 70 controls the driving of the feed motor 81 together with such printing operations.

Specifically, until the detection sensor 85 of the paper feed unit 80 detects the tip of the paper of the downstream side in the forward direction (S3), print feeding (S2) is performed by the platen roller 22. After the tip of the paper of the downstream side in the forward direction is detected by the detection sensor 85, the feed rollers 82, 83 are stopped (S4) at a point at which the above-described prescribed number of steps have passed.

When a further printing operation is necessary, the printing operation is continued. As illustrated in FIG. 4, the paper P is deflected in the gap 89*a*.

When the printing operation terminates, the control circuit 70 ends control to the thermal print head 21, and provides the first number of steps n1 to the stepping motor 41 to dispose a predetermined portion of the paper P (non-printed portion) at a predetermined position of the cutting unit 30.

At this point, the stepping motor 41 has already sent the paper P from the tip of the downstream side in its forward direction to its back end (the predetermined portion denotes a predetermined cutting position) so that the number of required steps (number of steps in correspondence to a length of the paper P to be cut) are stored by the control circuit 70.

After that, the stepping motor 41 provided with the first number of steps n1 and driven in a way corresponding to the number of steps n1 stops (S5). Immediately after stoppage, due to backlash of the gear train 42, looseness of a part to which the platen roller 22 is supported (for example, the shaft 25*b* serving as the rotating center of the metal plate member 25*a* and a hole formed on the body 110 of the printer 100 to support the shaft 25*b*) or the like, the platen roller 22 oscillates along the feeding direction of the paper P or along its rotating direction.

Therefore, after driving of the stepping motor 41 is stopped, that is, immediately after the predetermined portion of the paper P is disposed at a predetermined position of the cutting unit 30, when the cutting operation is performed by the cutting unit 30, the paper P is cut when the platen roller 22 oscillates. As a result, cutting positions of the paper P along the feeding direction become varied after oscillations of the platen roller 22 are settled therein.

On the contrary, in the printer 100 of the present embodiment, the cutting operation by the cutting unit 30 is not performed just after a predetermined portion of the paper P is positioned at the cutting unit 30, and the control circuit 70 commands the cutter motor 32 to stand by for a predetermined time (in the present embodiment, 100 [msec]) before the cutting operation (S6).

Thereby, the above-described oscillations of the platen roller 22 are settled so that variations of cutting positions of the paper P along the feeding direction can be suppressed.

In addition, the predetermined time for which the control circuit 70 commands the cutting unit 30 to wait for the cutting operations corresponds to the time taken for the oscillations of the platen roller 22 to settle. 100 [msec] or so is sufficient for a normal printer but not necessarily limited to such a time. The time can be set to be longer or shorter than 100 [msec] in accordance with the oscillating time of the platen roller in the printer.

In such a way, the positional relation between the engagement of the gear train 42 and the parts supporting the platen roller 22 (for example, a shaft 25*b* serving as a rotating center of the metal plate member 25*a* and a hole or the like formed on the body 110 of the printer 100 to support the shaft 25*b*) when oscillations of the platen roller 22 are settled are not changed by the settlement of the oscillations and almost constant. Therefore, the control circuit 70 commands the cutting unit 30 to perform cutting operation (S7) when the oscillations of the platen roller 22 are settled, making it possible to reduce the variations in the cutting positions in the feeding directions of the paper P.

In addition, when the cutter blades 31*a*, 31*b* of the cutting unit 30 cut the paper P, because the paper P is shorn by the cutter blades 31*a*, 31*b*, a portion of the paper P at a more upstream side than the cutter blades 31*a*, 31*b* along forward direction is pulled by the cutter blades 31*a*, 31*b* towards the downstream side in the forward direction. Because the paper P is pulled towards the downstream side in the forward direction in this way, the platen roller 22 being in contact with the paper P is also pulled by the paper P to be in a state forcefully rotated (a rotating state which is not the rotation according to the drive of the stepping motor 41) in the forward rotational direction which sends the paper P in the forward direction.

At this time, a frictional force between the paper P and the thermal print head 21 or the like of the printing unit 20 and a counteracting force or the like due to the pressing force acting among the mutually engaging gears of the gear train 42 are applied to the platen roller 22, consequently, a rotating force acts in the reverse rotational direction to the forward rotation (a direction of reverse rotation), and the rotating force comes into balance with a force pulling the paper P to the downstream side of the forward direction. However, if the paper P is completely cut by the cutter blades 31*a*, 31*b*, because the force pulling the paper P to the downstream side of the forward direction disappears, by a force pulling back the paper P towards the upstream side in the forward direction, the platen roller 22 rotates in a reverse direction for only a portion of backlash of the gear trains 42 or looseness or the like of the supported part so that the paper P is also pulled back to the upstream side.

Here, as described above, if the cutting is performed while the platen roller 22 is still in a state oscillating and there are variations in cutting positions, in a state that, after cutting, paper P is pulled back, there is a case in which the tip end of the downstream side in the forward direction of the paper P is returned to the position of the thermal print head 21 so that there is possibility of generating smashes of printed letters or the like during printing operation of the next time, or broken printed letters or the like by idling rotations of the portion of backlash of the gear trains 42.

However, in the printer 100 according to the present embodiment, after cutting operation (S7) by the cutting unit 30, the control circuit 70 controls the driving of the stepping motor 41 so that it is rotated in the forward direction for only a second number of steps n2 (S8) in correspondence to, for example, a portion of 8 letter printing dots sent towards the downstream side in the forward direction of the paper P. Thereby, the backlash of gear trains 42 is shifted to the reverse side of the forward direction of the paper P so that a state where the backlash is removed can be achieved in movements to the forward direction of the paper P.

Consequently, when the next printing operation is started, since such backlash is in an already removed state, there are no influences on printing operation of the next time so that generations of broken or smashed printed letters or the like can be prevented.

In addition, because the printer 100 according to the present embodiment does not perform removal actions for backlash before the start of printing, it is possible to shorten a period from the time when instructions of printing operations are inputted to the printer 100 to the time when the printing operations are started actually.

Meanwhile, in the present embodiment, after the backlash removal operation (S8), sequential operations are performed to send a portion of the downstream side in the forward direction of the cut and divided paper P to the discharge port 90 (S9 through S12). However, by performing the backlash removal operation (S8) after the paper P is cut (S7), the backlash removal operation (S8) and the operations to send the portion of the downstream side in the forward direction of the cut and divided paper P to the discharge port 90 (S9 through S12) can be performed simultaneously.

In this case, a time consumed for the operation to discharge from the discharge port 90 the portion of the paper P of the downstream side in the forward direction is not late. Therefore, an actual necessary time consumed from the time when printing operation instruction is inputted to the printer 100 to the time when the printed paper P (the portion of the downstream side within the cut paper P in the forward direction) is discharged from the discharge port 90 is not late by the removal operation of backlash.

Here, operations with respect to the portion of the downstream side of the cut and divided paper P in the forward direction are described in detail.

First, after the cutting unit 30 cut the paper P (S7) through the control of the cutting unit 30 by the control circuit 70, the control circuit 70 controls the driving of the feed motor 81 so that the paper P is sent in the forward direction with a high speed (350 [mm/sec]). By this control, the paper P is sent to the discharge port 90 of the downstream side in the forward directional with a high speed by the feed rollers 82, 83 (S9).

Then, the control circuit 70 controls the driving of the feed motor 81 based on the number of steps memorized when sending the paper P by the stepping motor 41 so that, immediately before the back end of the cut paper P (the end portion in the upstream side of the paper P in the forward direction) reaches the detection sensor 85 disposed on the paper feed unit 80 (S10), a control with respect to the feed motor 81 is switched from a high feeding speed to an intermediate feeding speed (300 [mm/sec]).

By such a control, the paper P is sent by the feed rollers 82, 83 towards the discharge port 90 of the downstream side in the forward directional with an intermediate speed (S11).

Furthermore, the control circuit 70 performs control at the above-described intermediate speed with respect to the feed motor 81 by a predetermined distance (a prescribed number of steps), thereafter stops the feed motor 81 once, and thereafter controls the feed motor 81 to reversely rotate. Then, the control circuit 70, when the back end of the cut paper P, that is, the end portion of the upstream side in the forward direction is detected by the detection sensor 86, controls the feed motor 81 to stop it so that the paper P is in a state waiting for paper to be received in which a portion of the paper is protruded outwardly from the discharge port 90 (S12).

Meanwhile, at the state of pull out standby for the paper P in which a portion of the paper is protruded outwardly from the discharge port 90 (S12), a part close to the back end of the paper P is in a state maintained by the feed roller 82, 83.

The control circuit 70 at the state waiting for paper to be received, waits for only a predetermined time set preliminarily, and if the paper P is received during a period from the standby to a predetermined time lapse, control to the paper feed unit 80 is terminated. On the other hand, in the case, if the paper P is not received after the predetermined time passes, the paper feed unit 80 is controlled to retrieve the paper P inwards.

Specifically, the detection sensor 86 detects whether the paper P is present or absent, and when the paper P is received, the detection sensor 86 does not detect the paper P (S13) so that, based on the detection results, the control circuit 70 terminates control to the paper feed unit 80.

On the other hand, when the paper P is not received, the paper P is detected by the detection sensor 86 (S13). Therefore, based on the detection results, the control circuit 70 determines whether a predetermined time has passed as standby time (S14), if the predetermined time has not passed, then processes of detecting the presence and the absence of the paper P (S13) and waiting for the predetermined time lapse (S14) are repeated until the predetermined time passes. If the paper P remains detected, and when the predetermined time passes, the control circuit 70 performs control to the paper feed unit 80 to retrieve the paper P (S15).

The retrieval of the paper P is achieved by reversely rotating the feed motor 81 by the control circuit 70. In this case, the feed roller 82 is reversely rotated so that the paper P maintained by the feed rollers 82, 83 in a clamped state therebetween is pulled back inwards from the discharge port 90, fed along the retrieval guide plate 87 disposed on a more upstream side than the feed rollers 82, 83 in the forward direction, then retrieved in a retrieval box (not shown) or the like disposed below the retrieval guide plate 87.

In the middle of the retrieval operation, during a period that the paper P is fed along the retrieval guide plate 87, the detection sensor 86 provided in the retrieval guide plate 87 detects the presence of the paper P. When the paper P is already retrieved by the retrieval box or others, or likewise, and the detection sensor independently of the retrieval guide plate 87 has not detect the presence of the paper P, the control circuit 70 then determines that the retrieval of the paper P is completed, thereby terminates retrieval operation by the reverse rotation of the feed motor 81 (S16) and terminates control to the paper feed unit 80.

As mentioned above in detail, according to the printer 100 of the present embodiment and the paper-feeding method of the printer 100 as the action thereof, variations in cutting positions due to oscillations by the platen roller 22 can be suppressed, together with suppressions of deviations in printing positions by backlash of the gear trains 42 or the like, improvements in printing quality of the paper can be realized.

In addition, the printer 100 according to the present embodiment, as thickness of the paper P becomes thicker, the shearing force required for cutting the paper P becomes larger, and a force pulling the paper P towards the downstream side in the forward direction becomes stronger so that its counteracting force also becomes larger.

Therefore, after cutting the paper P, when the force pulling the paper P towards the downstream side in the forward direction disappears, the amount of the paper P pulled back towards the upstream side in the forward direction also becomes larger.

In the printer 100 according to the present embodiment, if the control circuit 70 adjusts the second number of steps n2 in accordance to a thickness of the paper P, as the thickness of the paper P becomes thicker, the second number of steps n2 is made to be larger so that when the paper P differing in thickness is used, a proper cue can be performed (proper positional setting at the tip end of the paper P of the downstream side in the forward direction).

In addition, in the printer 100 according to the present embodiment, a speed discharging the paper P after cutting the paper P can be a higher speed 350 [mm/sec] than the conventional speed (for example, an intermediate speed of 300 [mm/sec] or so), thereby the time until the paper P is discharged from the discharge port 90 can be shortened.

Here, in a case of only the paper P is discharged simply at a high speed, even if the feed motor 81 is stopped to stop the feed rollers 82, 83, due to inertial force of the discharged paper P, it is difficult to stop precisely the paper P at a predetermined position of the discharge port 90 (for example, a position where a portion of the paper P is protruded outwardly from the discharge port 90).

In contrast, in the printer 100 according to the present embodiment, the control circuit 70 controls the feed motor 81 so that the after cut paper P is sent to the discharge port 90 at the high speed (350 [mm/sec]). Thereby, the time required to discharge the paper P can be shortened in comparison to the conventional time while by the high speed feeding thereof, immediately before a back end part of the cut paper P (an end part of the upstream side in the forward direction) passes through the detection sensor 85, the control circuit 70 drives the feed motor 81 to switch to an intermediate speed (300 [mm/sec]) slower than the high speed (350 [mm/sec]) which sends the paper P at the intermediate speed. Thereby, inertial force of the paper P is reduced so that the paper P can be stopped with high precision at a predetermined position of the discharge port 90 (for example, a position where a portion of the paper P is protruded outwardly from the discharge port 90).

Meanwhile, the two stage-feed speed to discharge the paper P towards the discharge port 90 is not limited to the above-described combination of 350 [mm/sec] and 300 [mm/sec]. A speed higher than 350 [mm/sec] can be adopted as the high speed and a speed lower than 300 [mm/sec] can be adopted as the intermediate speed in which a total time of feed times of the high speed and the intermediate speed is shorter than the feed time of the conventional speed which the intermediate speed is constant. Any combination thereby can be adopted.

In addition, a timing at which the control circuit 70 switches the discharging speed of the paper P from the high speed to the intermediate speed is not limited to the timing immediately before detecting the back end part of the paper P by the above-described detection sensor 85.

That is to say, because the feed motor 81 is a stepping motor, it is well fitted to a feed-forward control where the driving amount is preliminarily set by an applied number of steps (number of pulses). Therefore, the speed may be switched at a timing in which the number of steps applied to the feed motor 81 by the control circuit 70 becomes any predetermined value.

In addition, the switching of speed may be based on a timing in which the fact that the back end portion of the paper P passes is detected by the detection sensor 85 (a timing detecting the non-presence of the paper P).

To the printer 100 of the above-described embodiment, when the paper P is discharged from the discharge port 90, controls to process an error in which the paper P cannot be made to protrude from the discharge port 90 for some reason (the state waiting for paper to be received), as well as controls to process an error in which the retrieval operation of the paper P cannot be completed for any reason when performing a retrieval operation of the paper P after the state waiting for paper to be received, are added in Embodiment 2 which is described hereinafter.

That is, in a conventional printer, when the discharge port is blocked by a hand to forcefully stop the paper being discharged from the discharge port or a portion of the paper being in the state for waiting for paper to be received protruding from the discharge port is picked by fingers to forcefully stop the retrieval operation and so on for the purpose of mischief or the like, the fact that the paper being not normally discharged is detected and abnormal discharge of the paper is detected so that when detection results are input to the control circuit, all operations of the printer are stopped.

Then the printer stopped by such determination of abnormal discharge is checked by a service staff for maintenance so as to perform a recovery operation after no abnormality is confirmed and normal operation is revived thereby.

However, in such a printer, during a period from the time when a maintenance service staff arrives to the time when checking is completed and revival processing is completed, the printer cannot be used. In addition, the time span to recommencement of usage tends to be very long.

The printer 100 in Embodiment 2 is to solve such problems. The control circuit 70 of the printer 100 of the above-described Embodiment 1 determines forward feeding movements of the paper P (towards the downstream side in the forward direction) to be not successful, in the case the detection sensor 85 (paper discharge detector) continues to detect the paper P (S21 of FIG. 8) after discharge operation (S11) of the paper P is performed at an intermediate speed (a state in Embodiment 1 where the feed motor 81 is rotated forward and driven by only a predetermined number of steps and once stopped thereafter)

In this case, the paper P is resulted to be not normally discharged (in cases which the discharge port 90 is blocked by hand so that a portion of the paper P is not protruded from the discharge port 90 and slipping occurs between the feed rollers 82, 83 and the paper P or the like).

Figure 8:
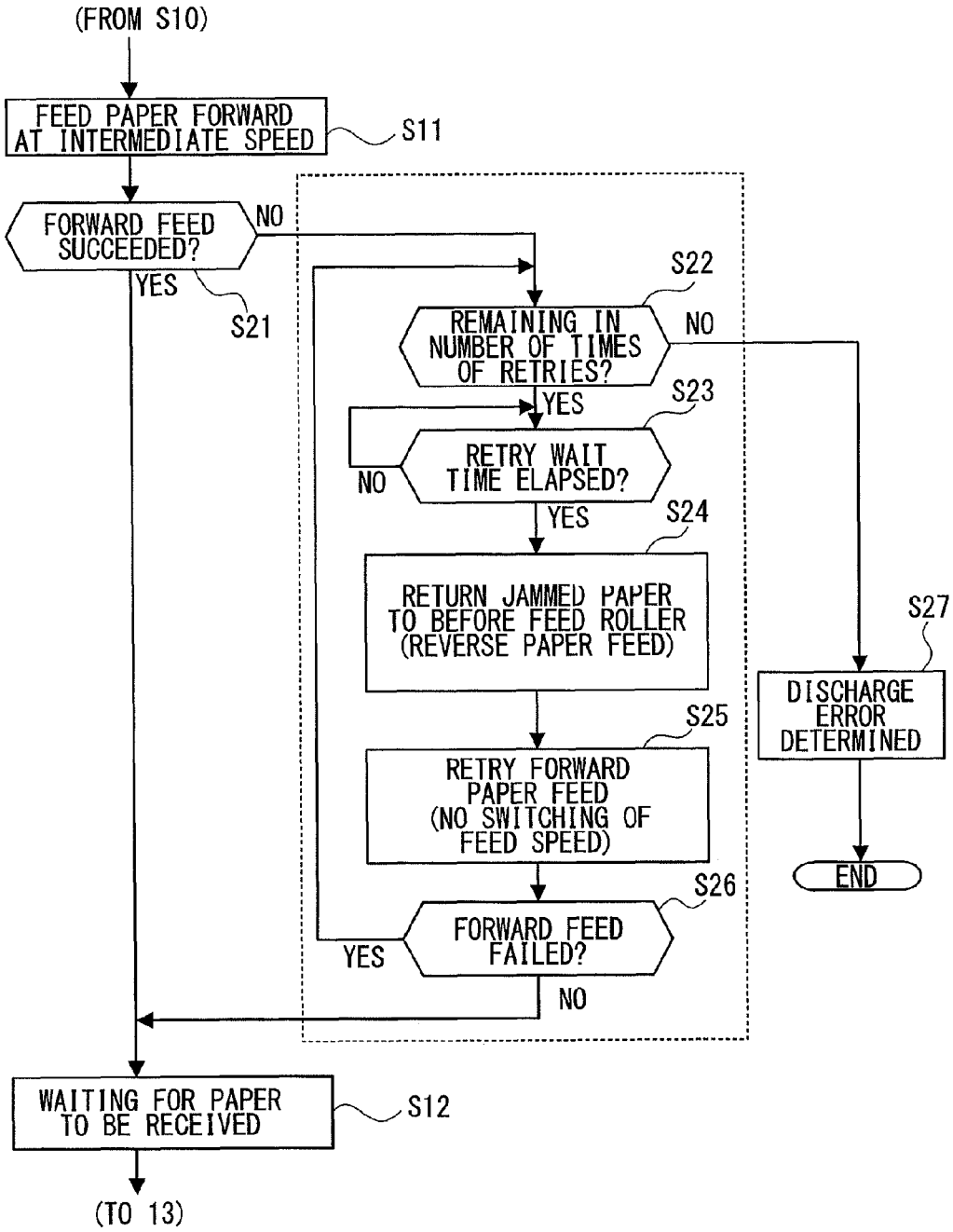
FIG. 8 is a flowchart (part 1) for the control by a control circuit of the printer according to a second embodiment which is added to the control by the control circuit of the printer according to the first embodiment.

On the other hand, after the discharge operation (S11) at the intermediate speed, in the case if the paper P is not detected by the detection sensor 85 (a state where the paper P is detected by the detection sensor 86), the forward feeding movements of the paper P is determined to be successful (S21 of FIG. 8)

In this case, the paper P becomes a normal state waiting for paper to be received (S12).

Then, based on detection results of the above-described detection sensor 85, when the paper P is not normally discharged (a state not wait a paper to be received), the feed rollers 82, 83 are reversely rotated to feed the paper P in a reverse direction to the forward direction (directly, controlling the feed motor 81 to drive in the reverse direction). Thereafter, the feed rollers 82, 83 are controlled to perform the re-discharge operation again (an operation to achieve the wait to be pulled out state) that rotates the feed rollers 82, 83 forward so that the paper P is fed again towards the discharge port 90.

At this time, even if the re-discharge operation is performed by the above-described control circuit 70, when the control circuit 70 determines the paper P to be not normally discharged (a state in which the detection sensor 85 is detected by the paper P), the controls by the control circuit 70 for the above-described re-discharge operation are repeated by each predetermined time span (a preliminarily set retry time) (S22 through S26 of FIG. 8)

Then, while controls to such re-discharge operations are repeated, when the detection sensor 85 no longer detects the paper P, the control circuit 70 determines the paper P to become the normal state waiting for paper to be received (S26→S12).

On the other hand, in the case where such re-discharge operations are repeated for a predetermined number of times (a preliminarily set retry number) but even so when no normal discharge of the paper P is detected, the control circuit 70 establishes that there is abnormality to discharges and terminates the re-discharge operation (S22→S27).

Meanwhile, the number of times (the above predetermined number of times) repeated for this re-discharge operation are pre-stored in the control circuit 70. As the control circuit 70 repeats the discharge operation every time, the memorized times are reduced. When the times become 0 (zero), the fact that abnormality in discharges is generated is established as described above and re-discharge operations are terminated.

In addition, in the printer 100 of the present embodiment, the control circuit controls the paper feed unit 80 so that other than the re-discharge operation for the case in which abnormality is detected during the above-described discharge operation, a re-retrieval operation is also performed for the case in which abnormality is detected during retrieval operation of the paper P.

Figure 9:
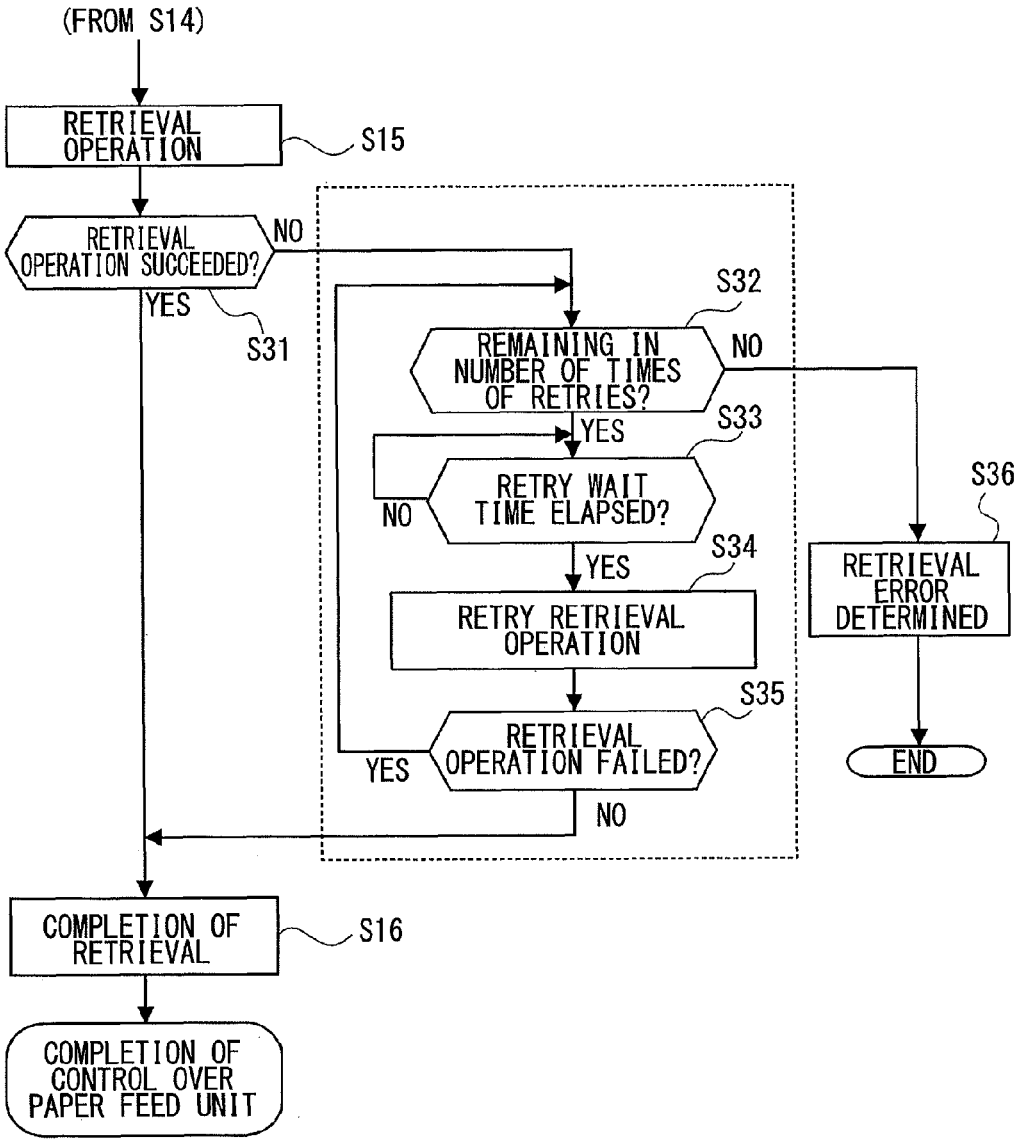
FIG. 9 is a flowchart (part 2) for the control by the control circuit of the printer according to a second embodiment which is added to the control by the control circuit of the printer according to the first embodiment.

That is, in the case where the detection sensor 86 (paper retrieval detector) continues to detect the paper P after the retrieval operation of the paper P (S15), the control circuit 70 determines that the paper P is not normally retrieved (S31 of FIG. 9).

On the other hand, in the case after the retrieval operation of the paper P (S15), the detection sensor 86 does not detect the paper P, the control circuit 70 determines that the paper P is normally retrieved (S31 of FIG. 9).

Then, by determination of retrieval success or retrieval failure of the paper P based on detection results by the detection sensor 86, when it is determined that the paper P is not normally retrieved, the once stopped feed rollers 82, 83 are controlled to rotate again (rotation in a reverse rotational direction that retrieves the paper P) (as a direct measure, controlling the feed motor 81 so that it is driven in the reverse rotational direction) to perform the re-retrieval operation.

At this time, even by controls to the re-retrieval operation of the above-described control circuit 70, in the case where the control circuit 70 determines that the paper P is not normally retrieved (a state in which the detection sensor 86 detects the paper P), the controls by the control circuit 70 for the above-described re-retrieval operation are repeated by each predetermined time span (a preliminarily set retry time) (S23 through S35 of FIG. 9)

Then, while the controls for such re-retrieval operation are repeated, when the detection sensor 86 is in a state not detecting the paper P, the control circuit 70 determines that the paper P is normally retrieved (S35→S16).

On the other hand, when the paper P is detected to be not normally retrieved even if such re-retrieval operations are repeated a predetermined number of times, the control circuit 70 establishes that there is abnormality to retrieval, and terminates the re-retrieval operation.

The number of times (the above predetermined number of times) repeated for this re-retrieval operation are pre-stored in the control circuit 70. As the control circuit 70 repeats the retrieval operation every time, the memorized times are reduced. When the times become 0 (zero), the fact that abnormality to retrieval is generated is established as described above and re-retrieval operations are terminated.

In the printer 100 of Embodiment 2 constituted in this way, when the discharge port 90 is blocked or the like, after discharge operation (S11) of the paper P is performed at the intermediate speed, as illustrated in FIG. 8, failure of the paper P to move forward (S21) (to the downstream side in the forward direction) is detected by the detection sensor 85. Based on such detection results, the control circuit 70 determines whether the preliminary memorized number of times of the re-discharge operations (the number of times of retry) is 0 (S22). When the number of times of re-discharge operations is not 0, the control circuit 70 stands by for a predetermined number of times until re-discharge operations are performed (S23). After the predetermined time passes, the feed motor 81 is reversely rotated (S24) to pull back the tip end of the paper P of the downstream side in the forward direction to the position of the feed roller 82, 83. The feed motor 81 is rotated forward (S25) so that the paper P once pulled back as such is again sequentially fed to the discharge port 90. By such sequential re-discharge operations, the detection sensor 85 detects (S26) whether forward feeding movement of the paper P is successful. When the fact that the paper P has been normally discharged is detected, the paper feed part 80 and so on are controlled to shift to the state waiting for paper to be received (S12).

When the discharge of the paper P (S26) fails by one time re-discharge operation, 1 (one) is deducted from the memorized number of times of re-discharge operations. The result thereof is determined as to whether or not being 0 (S22). If the number of times of re-discharge operations is not 0, until the number of times of re-discharge operations becomes 0 (S22) or discharge operations of the paper P is successful (S26), the control circuit 70 controls the paper feed unit 80 and so on so that the same re-discharge operations as described above are repeated.

When the number of times of re-discharge operations becomes 0 with the paper P remaining not to be normally discharged (S22), the control circuit 70 finally determines that the discharges operations are abnormal (S27) and stops the operations of the printer 100 to terminate the processes.

In this case, all maintenances are left to service staff.

On the other hand, even in the cases where the paper P is not normally discharged from the discharge port 90, if the re-discharge operations are performed, the paper P can be normally discharged from the discharge port 90 in many cases. In addition, because the case where the discharge port 90 is blocked for long hours is few, if the re-discharge operations are performed in a state in which the obstacle blocking the discharge port 90 is removed, then the paper P can normally be discharged from the discharge port 90.

Therefore, even if the paper P is not normally discharged for only once, by the printer 100 according to the present embodiment that performs discharge operations once again, differences are made in comparison to a conventional printer with controls stopped by one abnormal determination so that an opportunity to send a service staff for the maintenance of the printer 100 has been greatly reduced.

In addition, during maintenances by such service staffs, the printer 100 cannot operate but the printer 100 of the present embodiment can greatly reduce such opportunities so that the operation efficiency of the printer 100 can go up.

Furthermore, the printer 100 of the present embodiment repeats such re-discharge operations for the predetermined number of times so that the possibility that the discharge operations of the paper P is returned to normal can go up.

In addition, in the printer 100 according to the present embodiment, even if the paper P is in a state jammed on a narrow feed path leading to the discharge port 90 so that in the case where normal discharge cannot be performed under such a state, without discharge operations being not simply repeated, controls are performed so that the paper P is once pulled back towards the upstream side in the forward direction. Thereby, the possibility of cancellation of paper jamming can be heightened so as to further heighten the possibility of the normal state of discharge being returned by the re-discharge operations.

In the printer 100 in the present embodiment, in a case where the retrieval operations of the paper P are performed (S15 in FIG. 9), when a portion of the paper P protruding from the discharge port 90 is gripped or the like, the paper P cannot be normally retrieved. Therefore, failure of retrieval operations of the paper P is detected by the detection sensor 86 (S31). Based on the detection results, the control circuit 70 determines whether or not the pre-stored number (retry number of times) of times of re-retrieval operation is 0 (S32). When the number of times of re-retrieval operations is not 0, the control circuit 70 stands by for a predetermined time until re-retrieval operations are performed (S33). After the predetermined time passes, the feed motor 81 is reversely rotated to perform retrieval operation again (S34). By such series of re-retrieval operations, the detection sensor 86 detects whether retrieval of the paper P is successful or not (S35). If the paper P is detected to be normally retrieved, the control circuit 70 controls the paper feed unit 80 and so on to complete the retrieval operation of the paper P (S16).

When a single re-retrieval operation fails to retrieve the paper P (S35), 1 (one) is deducted from the memorized number of times of re-retrieval operations. The control circuit 70 determines whether or not the result thereof is 0 (S32) and controls the paper feed part 80 and so on to repeat the re-retrieval operations same as described above until the number of times of re-retrieval operations is 0 when it is not yet 0 (S32) or till retrieval operations of the paper P reaches success (S35).

When the paper P is still not normally retrieved but at the time the number of times of re-retrieval operations becomes 0 (S32), the control circuit 70 determines finally that the retrieval operations are abnormal (S36) and stops operations of the printer 100 for process termination.

In this case, all maintenances are left to a service staff.

On the other hand, even the cases where the paper P is not normally retrieved, if re-retrieval operations are performed, the paper P can be normally retrieved from the discharge port 90 in many cases. In addition, because the case where the paper P in a state is gripped for long hours is few, if the re-retrieval operations are performed in a state in which the obstacle as such is removed, then the paper P can be retrieved normally.

Therefore, even if the paper P is not normally retrieved for only once, by the printer 100 according to the present embodiment that performs retrieval operations once again, differences are made in comparison to a conventional printer with controls stopped by one abnormal determination so that an opportunity to send a service staff for the maintenance of the printer 100 has been greatly reduced.

In addition, during maintenances by such service staffs, the printer 100 cannot operate but the printer 100 of the present embodiment can greatly reduce such opportunities so that the operation efficiency of the printer 100 can go up.

Furthermore, the printer 100 of the present embodiment repeats such re-retrieval operations for the predetermined number of times so that the chance that the retrieval operations of the paper P being returned to normal can go up.

Needless to say that other than the above-described working effects, the printer 100 of Embodiment 2 illustrated as a modification of Embodiment 1 can have the same functions and effects already described in the printer 100 of Embodiment 1.

In addition, the effects of the printer 100 of Embodiment 2 are also one embodiment of paper-feeding method of the printer according to the present invention.

CROSS-REFERENCE TO RELATED APPLICATION

The present application claims priority from Japanese Patent Application No. 2010-256737 filed on Nov. 17, 2010 to the Japan Patent Office, the entire content of which is incorporated herein by reference in its entirety.

The invention claimed is:

1. A printer, comprising:

a printing unit having a platen roller rotatably supported around a shaft;

a power unit including a stepping motor, and a gear train to drive the stepping motor to transfer a force generated by the stepping motor to the platen roller and rotate the platen roller around the shaft;

a cutting unit provided at a further downstream of a forward direction than the platen roller to cut a paper at a certain position, the forward direction in which the paper printed by the printing unit is fed by a forward rotation of the platen roller; and a control unit to control a driving of the stepping motor and an operation of the cutting unit, wherein the control unit is configured to drive the stepping motor by a first number of steps to rotate the platen roller forward and place a certain portion of the paper at a predetermined position of the cutting unit on standby for a predetermined time, and then control the cutting unit to cut the paper, and after the cutting, drive the stepping motor by a second number of steps to rotate the platen roller forward, the second number of steps being a minimal number of steps necessary to remove backlash of the gear train.

2. A printer according to claim 1, wherein the control unit is configured to adjust the second number of steps according to a thickness of the paper.

3. A printer according to claim 1, further comprising a feed roller disposed at a further downstream of the paper forward direction than the cutting unit and controlled by the control unit to feed the paper towards a discharge port for discharging the paper, wherein the control unit is configured to control a driving speed of the feed roller to switch the paper feeding from a high speed feeding to an intermediate speed feeding, the high speed feeding in which the paper cut by the cutting unit is fed at a relatively high speed, the intermediate speed feeding in which the paper is fed after the high speed feeding at an intermediate speed which is slower than the high speed.

4. A printer according to claim 1, further comprising:

a paper discharge detector to detect an anomalous paper discharge from the discharge port for discharging the paper; and a feed roller disposed at a further downstream of the paper forward direction than the cutting part and controlled by the control unit to feed the paper towards the discharge port, wherein the control unit is configured to reversely rotate the feed roller to feed the paper in a direction reverse to the paper forward direction when the anomalous paper discharge is detected by the paper discharge detector, and then control the feed roller to perform a re-discharge operation in which the feed roller is rotated forward to feed the paper towards the discharge port.

5. A printer according to claim 4, wherein when the anomalous paper discharge is still detected by the paper discharge detector even after the re-discharge operation by the feed roller, the control unit is configured to control the feed roller to repeat the re-discharge operation with a predetermined interval until a normal paper discharge is detected by the paper discharge detector, and when the anomalous paper discharge is still detected by the paper discharge detector even after the re-discharge operation is repeated in a predetermined number of times, the control unit is configured to output a notification of anomaly and control the feed roller to stop the operation.

6. A printer according to claim 1, further comprising a paper retrieval detector configured to detect an anomalous paper retrieval, wherein when the anomalous paper retrieval is detected by the paper retrieval detector, the control unit is configured to control the feed roller to perform a re-retrieval operation in which the feed roller is rotated again.

7. A printer according to claim 6, wherein when the anomalous paper retrieval is still detected by the paper retrieval detector even after the re-retrieval operation by the feed roller, the control unit is configured to control the feed roller to repeat the re-retrieval operation with a predetermined interval until a normal paper retrieval is detected by the paper retrieval detector, and when the anomalous paper retrieval is still detected by the paper retrieval detector even after the re-retrieval operation is repeated in a predetermined number of times, the control unit is configured to output a notification of anomaly and control the feed roller to stop the operation.

8. A paper-feeding method of a printer which comprises a printing unit having a platen roller rotatably supported around a shaft, a power unit including a stepping motor and a gear train to drive the stepping motor to transfer a force generated thereby to the platen roller and rotate the platen roller around the shaft, a cutting unit provided at a further downstream of a forward direction than the platen roller to cut a paper at a certain position, the forward direction in which the paper printed by the printing unit is fed by a forward rotation of the platen roller, and a control unit to control a driving of the stepping motor and an operation of the cutting unit, the method comprising the steps of:

by the control unit, driving the stepping motor by a first number of steps to rotate the platen roller forward and placing a certain portion of the paper at a predetermined position of the cutting unit on standby for a predetermined time before the paper cutting by the cutting unit; and after the paper cutting by the cutting unit, driving the stepping motor by a second number of steps to rotate the platen roller forward, the second number of steps being a minimal number of steps necessary to remove backlash of the gear train.

9. A paper-feeding method of a printer according to claim 8, wherein the control unit adjusts the second number of steps according to a thickness of the paper.

10. A paper-feeding method of a printer according to claim 8, further comprising the step of switching the paper feeding from a high speed feeding to an intermediate speed feeding when feeding the paper cut by the cutting unit towards the discharge port, the high speed feeding in which the paper cut by the cutting unit is fed at a relatively high speed, the intermediate speed feeding in which the paper is fed after the high speed feeding at an intermediate speed which is slower than the high speed.

11. A paper-feeding method of a printer according to claim 8, further comprising the step of when the paper cut by the cutting unit is fed towards the discharge port and not normally discharged from the discharge port, feeding the paper in a direction reverse to the forward direction, and then performing a re-discharge operation n which the paper is fed forward towards the discharge port.

12. A paper-feeding method of a printer according to claim 11, further comprising the steps of when the paper is still not normally discharged even after the re-discharge operation, repeating the re-discharge operation with a predetermined interval until the paper is normally discharged, and when the paper is still not normally discharged even after the re-discharge operation is repeated in a predetermined number of times, outputting a notification of anomaly and stopping the operation.

13. A paper-feeding method of a printer according to claim 8, further comprising the step of performing a retrieval operation for the paper again when detecting that the paper is not normally retrieved.

14. A paper-feeding method of a printer according to claim 13, further comprising the steps of when the paper is still not normally retrieved even after the retrieval operation is performed again, repeating the retrieval operation with a predetermined interval until detecting that the paper is normally retrieved, and when detecting that the paper is still not normally retrieved even after the retrieval operation is repeated in a predetermined number of times, outputting a notification of anomaly and stopping the operation.

* * * * *